United States Patent [19]

James

[11] Patent Number: 4,703,523

[45] Date of Patent: Nov. 3, 1987

[54] INVALID HOISTS

[75] Inventor: David R. James, "Glenyard", England

[73] Assignee: Impro Limited, Gloucester, England

[21] Appl. No.: 918,341

[22] Filed: Oct. 15, 1986

[30] Foreign Application Priority Data

Nov. 6, 1985 [GB] United Kingdom ..... 8527285

[51] Int. Cl.[4] ..... A61G 7/10

[52] U.S. Cl. ..... 5/83; 5/86

[58] Field of Search ..... 5/81 R, 83, 84, 86, 5/87; 297/6, 337, 423

[56] References Cited

U.S. PATENT DOCUMENTS 3,493,245 2/1970 Nabinger ..... 5/86
3,623,169 11/1971 James ..... 5/81 R
3,629,880 12/1971 van Rhyn ..... 5/86
4,157,593 6/1979 Kristensson ..... 5/86
4,510,633 4/1985 Thorne ..... 5/86

*Primary Examiner*—Alexander Grosz
*Assistant Examiner*—Michael F. Trettel
*Attorney, Agent, or Firm*—Collard, Roe & Galgano

[57] ABSTRACT

A hoist for raising an invalid from a seated to a substantially standing position has a lifting arm arrangement with attachment points for a single back support sling. A mobile chassis on which the arm arrangement is mounted provides a footplate for the invalid. A seat mounted or mountable on the chassis is provided on to which the invalid can be lowered for transport in the seated position with the feet of the invalid resting on the footplate and the upper part of the body thereof supported by the sling.

9 Claims, 3 Drawing Figures

INVALID HOISTS

BACKGROUND OF THE INVENTION

1. Field of the Invention

The invention relates to invalid hoists, and in particular to hoists of the type which employ sling lifting of invalids and incorporate a mobile chassis so that an invalid can be transported on the hoist.

2. Description of the Prior Art

An invalid lifting concept has been proposed which utilises a single sling, passed around the back of an invalid below the arms thereof, to raise the invalid from a seated to a substantially standing position, with the feet resting on a support surface. Hoist constructions which employ this concept have been proposed with a mobile chassis employing a footplate or footrests providing said support surface. Such a hoist is very conveniently used for toileting of an invalid as, when raised to the substantially standing position, the lower part of the body of the invalid below the sling is accessible for clothing removal and other attention.

When the invalid is in the raised position a substantial portion of the body weight is taken by the footplate or footrests through the feet and legs, and thus support by the single back sling is reasonably comfortable, at least in the short term. However, with some invalids support in the raised position for any length of time, for example during transport from a hospital ward to a toilet, can result in a degree of discomfort and the object of the invention is to avoid such discomfort for the invalid.

SUMMARY OF THE INVENTION

According to the invention a hoist for use in raising an invalid from a seated to a substantially standing position has a lifting arm arrangement with attachment points for a single back sling, a mobile chassis on which the arm arrangement is mounted and which provides a footplate or footrests for the invalid, and a seat mounted or mountable on the chassis and on to which the invalid can be lowered for transport in the seated position with feet resting on the footplate or footrests and the upper part of the body of the invalid supported by the back sling.

The lifting arm arrangement preferably comprises two laterally spaced lifting arms at the outer ends of which the sling is in use attached, and for optimum utilization of the aforesaid lifting concept the sling attachment points desirably move along an arcuate path which is centred more-or-less directly above the footplate or footrests and which has a radius which approximates to the average length of a human thigh bone. A knee abutment pad may be provided against which the knees of a seated invalid to be lifted can be located so that, when lifting commences, the legs of the invalid below the knees are substantially vertical.

Preferably the seat is mounted on the chassis so as to be movable between an operative position and an inoperative position in which it does not impede the normal lifting procedure and allows access to the lower part of the body of a raised invalid supported in a substantially standing position on the footplate or footrests by the back sling. A U-shaped chassis, open at the front to fit around a wheelchair and/or toilet, is preferably used and the seat may be pivotally mounted on one side member of such a chassis. Locking means may be provided selectively to lock the seat in either of said operative and inoperative positions.

For toileting purposes the seat may have a toilet aperture and be designed to support a removable toilet pan beneath the aperture.

Other features of the invention will be apparent from the following description, drawings and claims, the scope of the invention not being limited to the drawings themselves as the drawings are only for the purpose of illustrating ways in which the principles of the invention can be applied. Other embodiments of the invention utilising the same or equivalent principles may be made as desired by those skilled in the art without departing from the present invention and the purview of the appended claims.

DESCRIPTION OF THE PREFERRED EMBODIMENT

Figure 1:
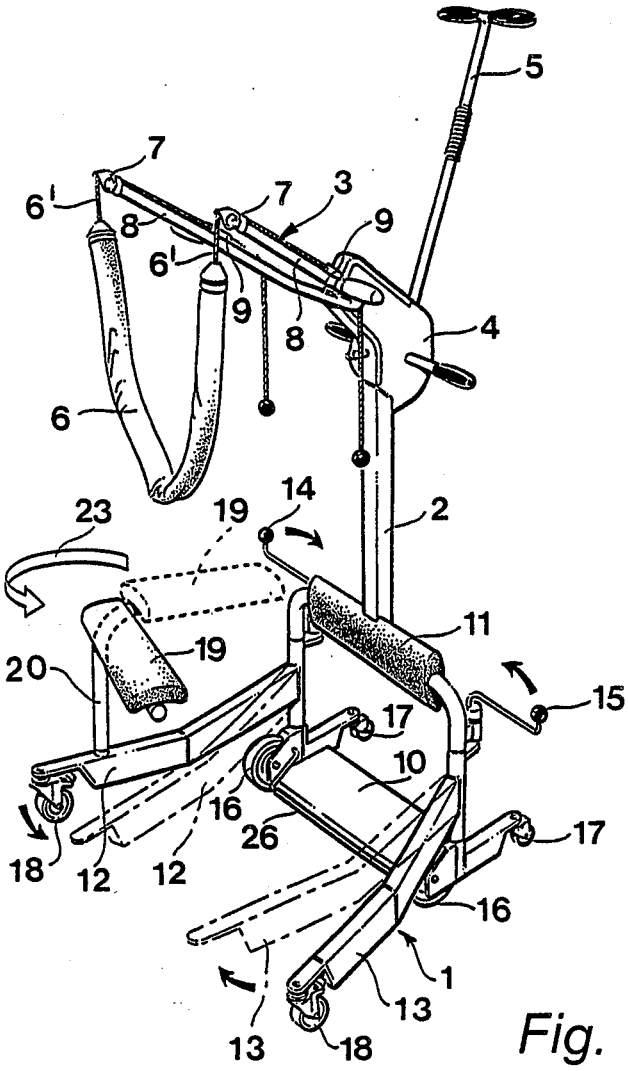
FIG. 1 is a front perspective view of an invalid hoist providing a preferred embodiment of the invention.
Figure 2:
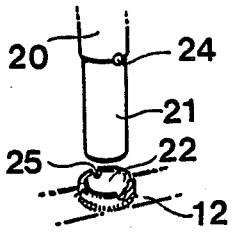
FIGS. 2 and 3 are respectively detail perspective views of the embodiment.

The hoist comprises a mobile chassis 1 supporting centrally, at the rear, an upstanding column 2. A pivotal lifting arm arrangement 3 projects forwardly over the chassis 1 from the column 2 which, at the top, houses a lifting mechanism 4 with an operating lever 5 for manual operation. Movement of the lever 5 through 180°, from an upper vertical position to a lower position extending downwards directly behind the column 2 produces a full operative lifting movement of the arm arrangement 3.

A tubular back sling 6, with a resilient filling, in use extends around the back of the invalid below the arms thereof. The sling 6 has attachment cord tails 6' by which it can be tightened around the invalid before lifting commences. These cords 6' pass over pulleys at the outer ends 7 of laterally spaced lifting arms 8, which pulleys represent the sling attachment points of the arm arrangement 3. After the sling 6 has been tightened around the invalid, the tails 6' are engaged with jamming cleats 9 on the arms 8.

The chassis 1 incorporates a footplate 10 on which the feet of the invalid to be lifted are initially placed, a knee abutment pad 11 being provided for location of the knees of the invalid with the legs thereof below the knees substantially vertical. Movement of the lifting arm arrangement throughout said full lifting range then lifts the invalid to a substantially standing position on the footplate 10, supported by the back sling 6. During lifting the sling attachment points at the outer ends 7 of the arms 8 traverse an arcuate path centred directly above the footplate 10 and are of a radius approximating to the average length of a human thigh bone.

The chassis 1 is of open-fronted U-shaped form with forwardly projecting side members 12 and 13. The chassis members 12 and 13 are pivotable by means of levers 14 and 15 between the maximum width position shown in full lines and the minimum width position shown in broken lines in FIG. 1. The maximum width allows the chassis 1 to pass around wheelchairs, for example, whereas the minimum width is more convenient for transport and passing through doorways etc. Mobility of the chassis is provided by intermediate fixed-axis wheels 16, rear stabiliser castor wheels 17 and front castor wheels 18. The ground-contact points of the six wheels are not coplanar, and the hoist rests either on the wheels 16 and 17 or on the wheels 16 and 18. The former of these ground-contact conditions appertains when the hoist is unloaded or when an invalid is supported in said raised position, thus providing the manoeuvrability of a short wheel base with directional stability provided by the fixed-axis wheels 16.

If the invalid, bearing in mind the condition thereof, has to be on the hoist for any length of time and/or transported a considerable distance and might suffer discomfort if maintained in said raised position the support of a seat 19 can be employed. This seat 19 presents an elongate padded surface, rectangular in plan view and which is laterally curved, and in the operative position illustrated in full lines in FIG. 1 extends laterally of the chassis 1 above the chassis members 12 and 13 and below the ends 7 of the arms 8. It has a tubular side support 20 terminating in a reduced-diameter bottom end cylindrical spigot 21 which seats in a cylindrical support socket 22 in the chassis side member 12. This enables the seat 19 to be removed when not required, and to pivot between said operative position and an inoperative position which is illustrated in broken lines in FIG. 1 and in which it generally overlies the chassis member 12. In the latter position it does not impede the lifting procedure and, if required, it can be pivoted to the operative position (in the direction of the arrow 23) behind the invalid who can then be lowered on to the seat 19 whilst the upper part of the body of the invalid remains supported by the back sling 6 and the feet remain on the footplate 10. Locking means, comprising a pin 24 on the spigot 21 and notches such as 25 at the top of the socket 22, lock the seat 19 in either of said positions and before the seat 19 can be moved it first has to be lifted to free the pin 24 from the notch 25 in which it is at the time engaged.

Figure 3:
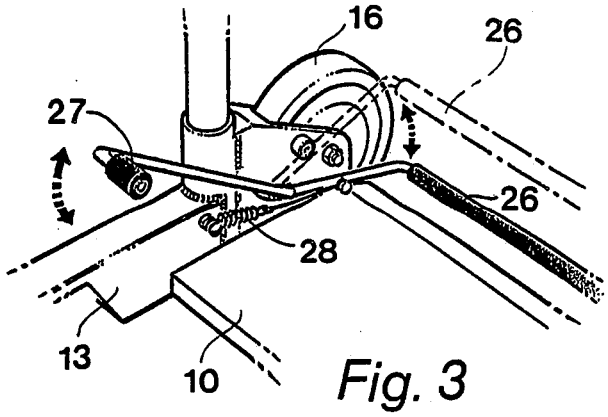

A heel retaining bar 26 (see particularly FIG. 3) is fitted at the front of the footplate 10, this being needed for invalids with some physical disabilities in order to prevent their feet slipping off the footplate 10. It is operated by a foot lever 27 and moved against an overcentre spring 28 between an inoperative position (shown in full lines) in which it is positioned below the top support surface of the footplate 10, and a raised operative position above that surface as shown in broken lines in FIG. 3.

I claim:

1. A hoist for raising an invalid from a seated to a substantially standing position utilizing a single back support sling, comprising:

a pivotal lifting arm arrangement, said arm arrangement having laterally spaced attachment points for a single back support sling;

a mobile chassis on which said arm arrangement is mounted, said chassis including a footplate or footrests for the invalid and so positioned that normal pivotal movement of said lifting arm arrangement raises the invalid to the standing position while supported by said simple sling with the feet resting on said footplate or footrests; and a seat mounted directly on said chassis and onto which the invalid can be lowered, for transport in seated position, by downward pivotal movement of said lifting arm arrangement with the feet of the invalid resting on the footplate or footrests and the upper part of the body of the invalid supported by said back support sling.

2. A hoist according to claim 1, wherein said seat is mounted on the chassis in such manner as to be movable between an operative position, for transport of the invalid in said seated position, and an inoperative position in which the seat does not impede a normal lifting procedure and in which access to the lower part of the body of a raised invalid, with the latter supported by said sling in a substantially standing position on the footplate or footrests, is not impeded.

3. A hoist according to claim 2, wherein locking means are provided by which said seat can selectively be locked in either one of said operative and inoperative positions.

4. A hoist according to claim 1, wherein said seat is detachably mounted on said chassis.

5. A hoist according to claim 1, wherein said lifting arm arrangement comprises two laterally spaced lifting arms, and said attachment points are respectively positioned at the outer ends of said lifting arms.

6. A hoist according to claim 5, wherein said sling attachment points during raising and lowering movement of said arm arrangement move along an arcuate path which is centred more or less directly above the footplate or footrests and which has a radius approximating to the average length of a human thigh bone.

7. A hoist according to claim 6, wherein a knee abutment pad is mounted on said chassis and is positioned so that the knees of a seated invalid to be lifted can be located against said abutment pad with the legs of the invalid below the knees substantially vertical.

8. A hoist for raising an invalid from a seated to a substantially standing position utilizing a single back support sling, comprising:

a lifting arm arrangement, said arm arrangement having attachment points for a single back support sling;

a mobile chassis on which said arm arrangement is mounted, said chassis including a footplate or footrests for the invalid and a side member; and a seat mounted on said chassis and onto which the invalid can be lowered for transport in the seated position with the feet of the invalid resting on the footplate or footrests and the upper part of the body of the invalid supported by said back support sling, said seat being of elongate shape and pivotally mounted on said side member of the chassis for movement between an operative position for transport of the invalid in the seated position, in which the seat extends from above said side member and laterally of the chassis, and an inoperative position in which the seat generally overlies said side member and does not impede a normal lifting procedure, in said inoperative position of the seat access to the lower part of the body of a raised invalid, with the latter supported by said sling in a substantially standing position on the footplate or footrests, not being impeded.

9. A hoist for raising an invalid from a seated to a substantially standing position utilizing a single back support sling, comprising:

a lifting arm arrangement, said arm arrangement having attachment points for a single back support sling;

a mobile chassis on which said arm arrangement is mounted, said chassis including a footplate or footrests for the invalid and a support socket; and a seat mounted on said chassis and onto which the invalid can be lowered for transport in the seated position with the feet of the invalid resting on the footplate or footrests and the upper part of the body of the invalid suported by said back support sling; said seat having a side support with a lower end spigot pivotally received in said support socket of the chassis so that the seat is pivotally movable between an operative position, for transport of the invalid in said seated position, and an inoperative position in which the seat does not impede a normal lifting procedure and in which access to the lower part of the body of a raised invalid, with the latter supported by said sling in a substantially standing position on the footplate or footrests, is not impeded.

* * * * *